US009121288B2

(12) United States Patent
Campbell et al.

(10) Patent No.: US 9,121,288 B2
(45) Date of Patent: Sep. 1, 2015

(54) TURBINE BLADE WITH TUNED DAMPING STRUCTURE

(75) Inventors: Christian X. Campbell, Oviedo, FL (US); Stephen J Messmann, Charlotte, NC (US)

(73) Assignee: Siemens Energy, Inc., Orlando, FL (US)

( * ) Notice: Subject to any disclaimer, the term of this patent is extended or adjusted under 35 U.S.C. 154(b) by 545 days.

(21) Appl. No.: 13/464,108

(22) Filed: May 4, 2012

(65) Prior Publication Data

US 2013/0294913 A1 Nov. 7, 2013

(51) Int. Cl.
*F01D 5/16* (2006.01)
*F01D 5/20* (2006.01)

(52) U.S. Cl.
CPC ... *F01D 5/16* (2013.01); *F01D 5/20* (2013.01); *F05D 2300/6033* (2013.01)

(58) Field of Classification Search
USPC ..... 415/119; 416/145, 500
See application file for complete search history.

(56) References Cited

U.S. PATENT DOCUMENTS

| | | | | |
|---|---|---|---|---|
| 1,833,751 | A * | 11/1931 | Kimball | 416/222 |
| 2,689,107 | A | 9/1954 | Odegaard | |
| 2,783,023 | A * | 2/1957 | Stalker | 416/214 R |
| 4,460,314 | A | 7/1984 | Fuller | |
| 4,484,859 | A | 11/1984 | Pask et al. | |
| 5,165,860 | A | 11/1992 | Stoner et al. | |
| 5,820,343 | A | 10/1998 | Kraft et al. | |
| 6,039,542 | A | 3/2000 | Schilling et al. | |
| 6,155,789 | A | 12/2000 | Mannava et al. | |
| 6,283,707 | B1 | 9/2001 | Chin | |
| 6,471,484 | B1 | 10/2002 | Crall | |
| 6,607,359 | B2 | 8/2003 | von Flotow | |
| 7,070,390 | B2 | 7/2006 | Powell | |
| 7,217,093 | B2 | 5/2007 | Propheter et al. | |
| 7,270,517 | B2 * | 9/2007 | Garner | 416/145 |
| 7,278,830 | B2 | 10/2007 | Vetters | |
| 7,736,124 | B2 | 6/2010 | Bauer et al. | |
| 2007/0041829 | A1 * | 2/2007 | Bonnet | 415/119 |
| 2008/0313899 | A1 * | 12/2008 | Bauer et al. | 29/889.7 |
| 2010/0232968 | A1 | 9/2010 | Miller | |
| 2011/0110762 | A1 * | 5/2011 | Campbell et al. | 415/119 |
| 2013/0206525 | A1 * | 8/2013 | Ogata | 188/381 |
| 2013/0276455 | A1 * | 10/2013 | Fisk et al. | 60/805 |

FOREIGN PATENT DOCUMENTS

| | | | |
|---|---|---|---|
| GB | 2106996 A | * | 4/1983 |
| JP | 55-46042 A | * | 3/1980 |

(Continued)

OTHER PUBLICATIONS

Namura, Vibration Attenuating Structure for Turbine, Mar. 31, 1980, Abstract for JP 55-46042A.*

(Continued)

*Primary Examiner* — Liam McDowell

(57) ABSTRACT

A turbine blade is provided comprising: a root; an airfoil comprising an external wall extending radially from the root and having a radially outermost portion; and a damping structure. The external wall may comprise first and second side walls joined together to define an inner cavity of the airfoil. The damping structure may be positioned within the airfoil inner cavity and coupled to the airfoil so as to define a tuned mass damper.

15 Claims, 6 Drawing Sheets

(56) References Cited

FOREIGN PATENT DOCUMENTS

| | | | | |
|---|---|---|---|---|
| JP | 55-46043 | A | * | 3/1980 |
| JP | 56-47601 | A | * | 4/1981 |
| WO | WO 2012/032852 | A1 | * | 3/2012 |

OTHER PUBLICATIONS

Hasegawa, Vibration Attenuator for Turbine Blade, Mar. 31, 1980, Abstract for JP 55-46043A.*

Azami, Vibration Damping Construction for Turbine, Apr. 30, 1981, Abstract for JP 56-47601A.*

* cited by examiner 150
154
402
152
400
134C
234C
134B
234B
140

150
152
134C
402
140
134B
400
154

150
152
134C
402
140
134B
400
154

TURBINE BLADE WITH TUNED DAMPING STRUCTURE

STATEMENT REGARDING FEDERALLY SPONSORED DEVELOPMENT

Development for this invention was supported in part by Contract No. DE-FC26-05NT42644, awarded by the United States Department of Energy. Accordingly, the United States Government may have certain rights in this invention.

FIELD OF THE INVENTION

The present invention relates to a turbine blade having a tuned damping structure.

BACKGROUND OF THE INVENTION

Turbine blades commonly encounter vibration induced by hot working gases engaging them during typical operation. A number of conventional methods have been proposed to reduce this induced vibration. For example, a tip shroud has been used to reduce induced vibration in medium sized blades, but in large sized blades, such a tip shroud introduces an undesired centrifugal pull load. In another example, damper pins have been installed to reduce induced vibration in small sized blades, but in large sized blades, these damper pins have proved ineffective.

SUMMARY OF THE INVENTION

In accordance with a first aspect of the present invention, a turbine blade is provided comprising: a root; an airfoil comprising an external wall extending radially from the root and having a radially outermost portion; and a damping structure. The external wall comprises first and second side walls joined together to define an inner cavity of the airfoil. The damping structure may be positioned within the airfoil inner cavity and coupled to the airfoil so as to define a tuned mass damper.

The damping structure may comprise a damping element having first and second ends, the first end being coupled to the airfoil and the second end being free to move within the airfoil inner cavity. The damping element second end may be located near the external wall radially outermost portion and the damping element first end may be located nearer to the root than the damping element second end.

The damping structure may further comprise a tip mass member coupled to the second end of the damping element. The damping structure may also comprise an attachment member coupled to the first end of the damping element, wherein the attachment member couples the damping element to the airfoil.

The tip mass member may be configured and sized so as to cause the damping structure to substantially match a bending normal mode frequency of the airfoil. The tip mass member may have a generally U-shape configuration so as to be fitted over the second end of the damping element.

The tip mass member may be configured and sized so as to cause the damping structure to substantially match a torsion normal mode frequency of the airfoil. The tip mass member may have a substantial portion of its mass offset from a center of gravity of the mass member.

The damping element may comprise a ceramic matrix composite damping element. The tip mass member may comprise a tungsten alloy tip mass member.

In accordance with a second aspect of the present invention, a turbine blade is provided comprising: a root; an airfoil comprising an external wall coupled to and extending radially from the root and having a radially outermost portion defining a tip of the airfoil, the external wall comprising first and second side walls joined together to define an inner cavity of the airfoil; and a damping structure positioned within the airfoil inner cavity comprising a damping element having first and second ends, the first end being coupled to the airfoil and the second end being free to move within the airfoil inner cavity.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiments, reference is made to the accompanying drawings that form a part hereof, and in which is shown by way of illustration, and not by way of limitation, a specific preferred embodiments in which the invention may be practiced. It is to be understood that other embodiments may be utilized and that changes may be made without departing from the spirit and scope of the present invention.

Figure 1:
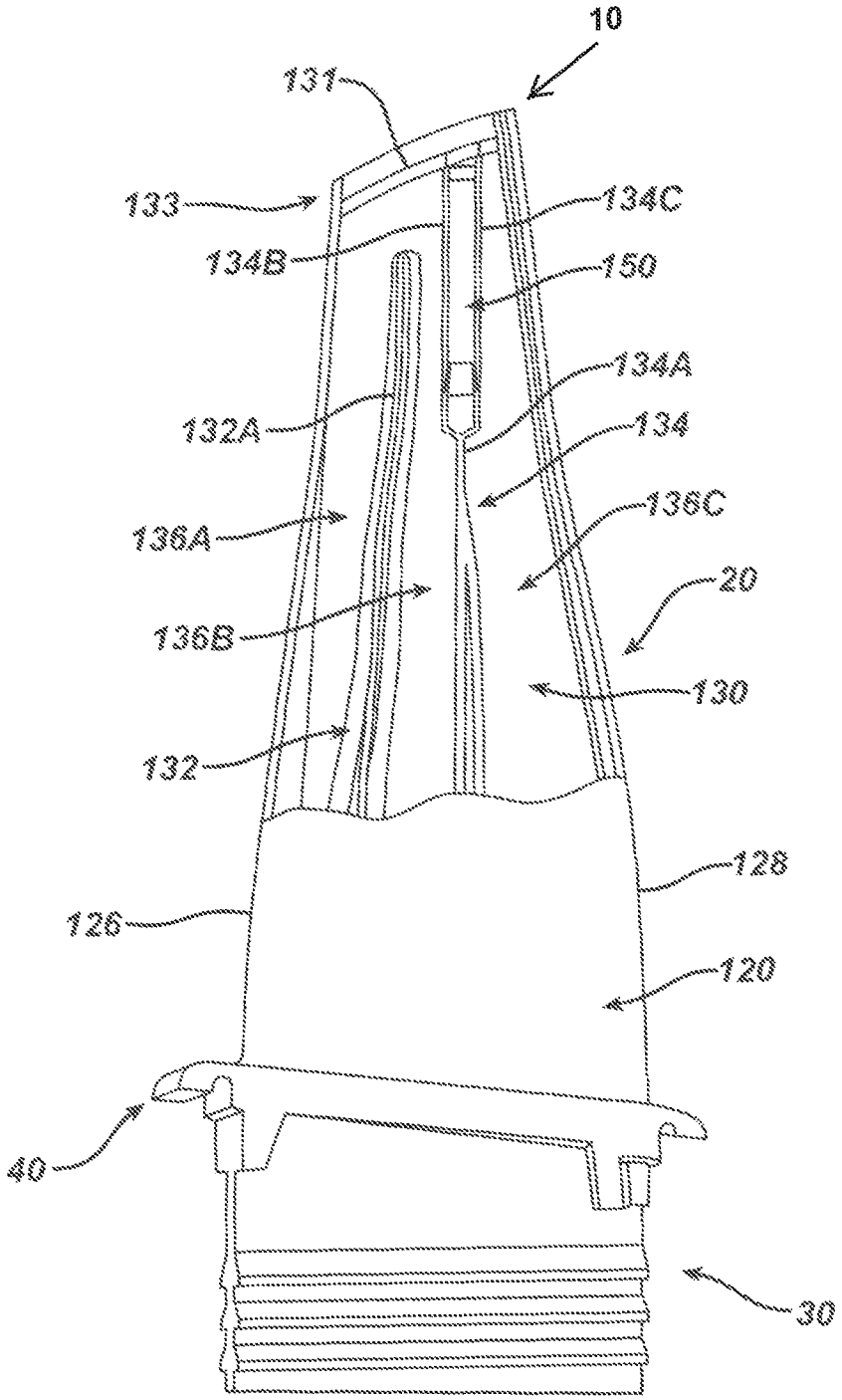
FIG. 1 is a side view, with a portion of a sidewall removed, of a blade constructed in accordance with the present invention.

Referring now to FIG. 1, a turbine blade 10 constructed in accordance with an embodiment of the present invention is illustrated. The blade 10 is adapted to be used in a gas turbine (not shown) of a gas turbine engine (not shown). Within the gas turbine are a series of rows of stationary vanes and rotating blades. Typically, there are four rows of blades in a gas turbine. It is contemplated that the blade 10 illustrated in FIG. 1 may define the blade configuration for a third row of blades in the gas turbine.

The blades are coupled to a shaft and disc assembly (not shown). Hot working gases from a combustor section (not shown) in the gas turbine engine travel to the rows of blades. As the working gases expand through the turbine, the working gases cause the blades, and therefore the shaft and disc assembly, to rotate.

The turbine blade 10 comprises an airfoil 20, a root 30 and a platform 40, which, in the illustrated embodiment, may be formed via a conventional casting operation as a single integral unit from a material such as a metal alloy 247. The root 30 functions to couple the blade 10 to the shaft and disc assembly in the gas turbine. The airfoil 20 comprises an external wall 120 extending radially from the root 30. The external wall 120 comprises a first generally concave pressure sidewall 122 and a second generally convex suction sidewall 124, see FIG. 2. The first and second sidewalls 122 and 124 are joined together at a leading edge 126 and a trailing edge 128 and define an airfoil internal cavity 130.

Radially outermost sections 122A and 124A of the first and second sidewalls 122 and 124 define a radially outermost portion 120A of the external wall 120. A tip plate 131 is cast with the external wall 120 and is joined to the outermost portion 120A of the external wall 120 so as to seal the external wall outermost portion 120A. The external wall outermost portion 120A and the tip plate 131 together define a tip 133 of the airfoil 20. In the illustrated embodiment, the tip plate 131 is cast with an opening 131A, see FIG. 2. As will be discussed further below, a seal plate 131B is brazed or welded to the tip plate 131 and the outermost sections 122A and 124A so as to close and seal the opening 131A.

The airfoil 20 further comprises first and second rib structures 132 and 134 extending between the first and second sidewalls 122 and 124, see FIG. 1. The first and second rib structures 132 and 134 define first, second and third cooling air flow paths 136A-1360 through the internal cavity 130. Cooling air enters through the base of the root 30, passes into the first cooling air flow path 136A, next into the second cooling air flow path 136B and then into the third cooling air flow path 136C so as to cool the airfoil 20. A plurality of orifices (not shown) are provided in the airfoil 20, e.g., along the leading and trailing edges 126 and 128, in the first and second sidewalls 122 and 124 and in the tip plate 131 through which the cooling air exits the airfoil 20.

Figure 3:
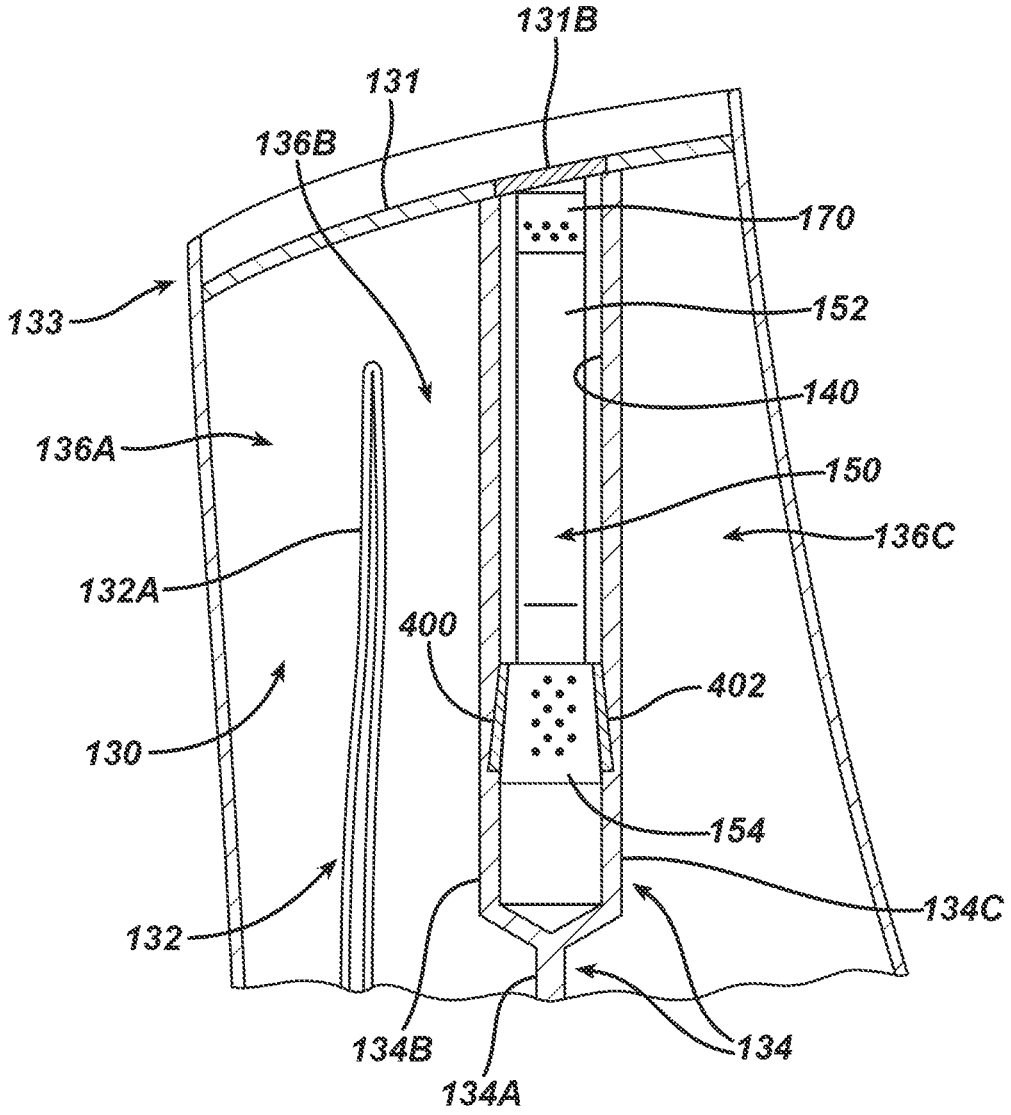
FIG. 3 is an enlarged view of a top portion of the blade illustrated in FIG. 1 with a portion of an airfoil external wall removed.

The first rib structure 132 is defined by a single rib 132A extending radially from the root 30, through the platform 40 and into the airfoil 20, where it is located between the first and second sidewalls 122 and 124 and terminates prior to the tip plate 131, see FIGS. 1 and 3. The second rib structure 134 is defined by a first rib 134A located between the first and second sidewalls 122 and 124 and spaced laterally from the rib 132A. The first rib 134A extends from a location near the platform 40 radially outwardly and, prior to reaching the tip plate 131, separates into spaced-apart second and third ribs 134B and 134C. The second and third ribs 134B and 134C define with adjacent portions of the first and second sidewalls 122 and 124 a pocket 140. The tip plate opening 131A is generally positioned over the pocket 140.

Figure 2:
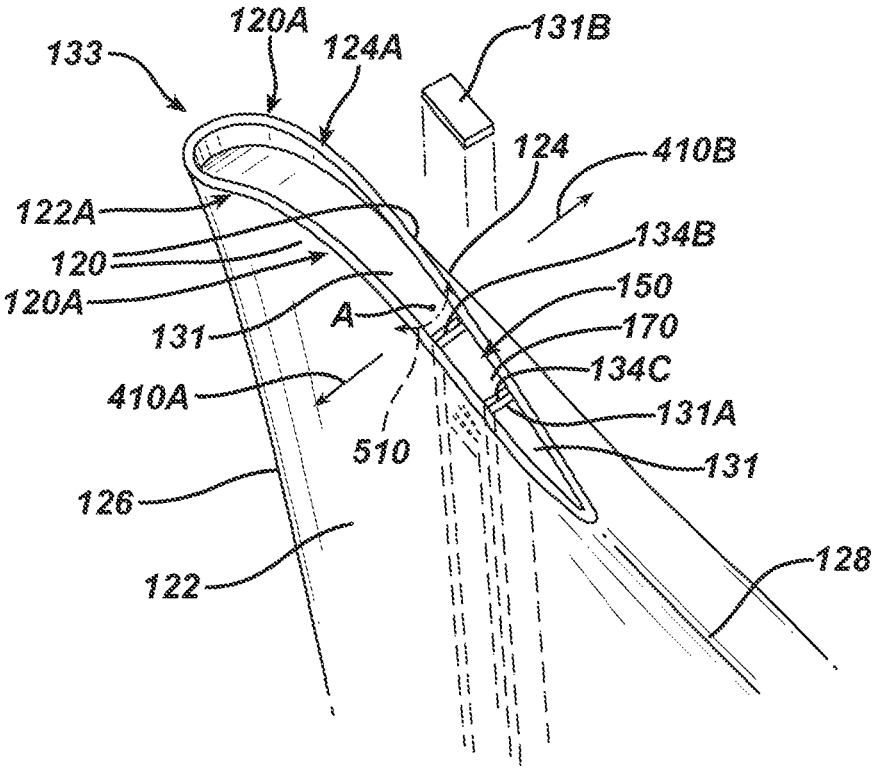
FIG. 2 is a view looking down on the blade, wherein an opening is provided in the airfoil tip plate.
Figure 4:
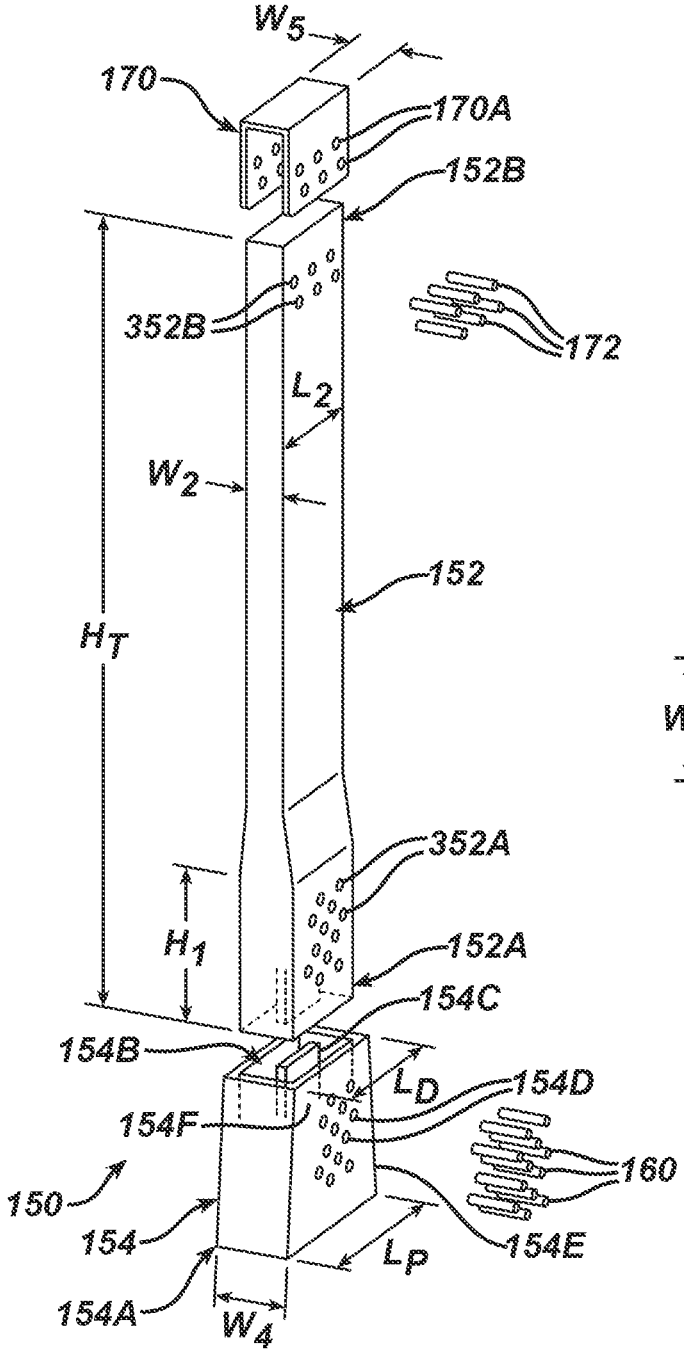
FIG. 4 is an exploded perspective view of a damping structure constructed in accordance with a first embodiment of the present invention.
Figure 4A:
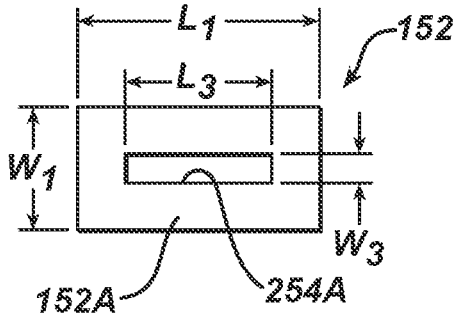
FIG. 4A is an end view of the damping element illustrated in FIG. 4.

A damping structure 150 is positioned within the pocket 140 and, in the illustrated embodiment, defines a tuned mass damper, see FIGS. 2-4. The damping structure 150 comprises a damping element 152 having first and second ends 152A and 152B, see FIG. 4. The first end 152A is provided with a generally rectangular internal slot 254A, which is centered within the first end 152A, see FIG. 4A. In the illustrated embodiment, the damping element 152 has an overall height $H_T$ of about 100 mm; the first end 152A has a length $L_1$ of about 20 mm, a width $W_1$ of about 8 mm and height $H_1$ of about 20 mm; the second end 152B has a length $L_2$ of about 20 mm and a width $W_2$ of about 5 mm; and the slot 254A has a $W_3$ of about 1.2 mm and a length $L_3$ of about 12 mm, see FIGS. 4 and 4A. These dimensions are provided for purposes of illustration and may be varied based on, for example, blade size. Preferably, the damping element 152 is formed from a material having material properties of a low modulus of elasticity, a high coefficient of damping and the ability to withstand temperatures up to about 600 degrees C. For example, the damping element 152 may be formed from a ceramic matrix composite having an elastic modulus less than 100 GPa, and preferably less than 50 GPa. One example of a ceramic matrix composite is an A-N720 oxide-oxide ceramic matrix composite.

The damping structure 150 further comprises an attachment member 154 comprising a main housing 154A defining an inner cavity 154B and a coupling member 154C centered within the inner cavity 154B. The attachment member 154 is fitted over the first end 152A of the damping element 152 such that the coupling member 154C is received in the slot 254A in the damping element first end 152A. First pins 160 extend through corresponding openings 154D in the attachment member main housing 154A (located in one or both opposing sides of the main housing 154A), corresponding openings 352A in the damping element first end 152A and corresponding openings (not shown) in the coupling member 154C. The pins 160 may have a diameter of about 1.5 mm and may be formed from a blade alloy such as a nickel superalloy. A weld bead may be provided to hold the pins 160 positioned within the openings 154D in the attachment member main housing 154A. The attachment member 154 is preferably formed from a light weight material capable of withstanding temperatures up to about 600 degrees C. An example of such a material is a blade alloy, such as a nickel superalloy.

The attachment member 154 is coupled to the airfoil 120 at a location within the internal cavity 130 inwardly from the airfoil tip 133 such that the second end 152B of the damping element 152 is located near the airfoil tip 133. The width or distance between the first and second airfoil sidewalls 122 and 124 at or near the airfoil tip 133 is small, e.g., about 14 mm. Hence, a width $W_4$ of the attachment member 154 must be selected so as to fit between the first and second sidewalls 122 and 124 of the airfoil. The attachment member 154 in the illustrated embodiment has a proximal end 154E with a length $L_P$ greater than a length $L_D$ of a distal end 154F.

Figures 5A, 5B, 5C:
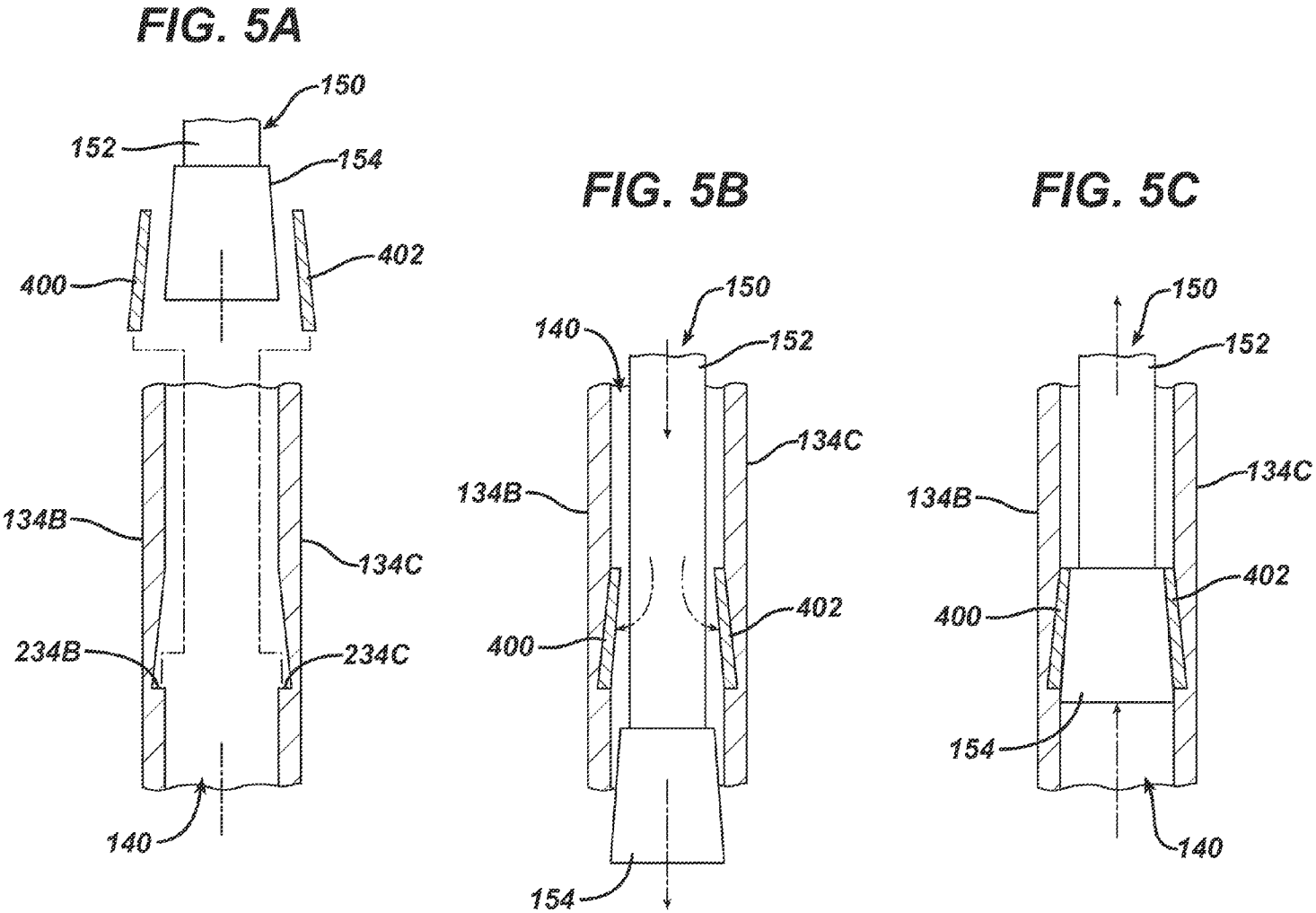
FIGS. 5A-5C illustrate steps used to couple an attachment member to the airfoil.

An example process and structure for securing the attachment member 154 to the second and third ribs 134B and 134C will be discussed with reference to FIGS. 5A-5C. As noted above, the second and third ribs 134B and 134C define with adjacent portions of the first and second sidewalls 122 and 124 a pocket 140. Each of the ribs 134B and 134C is provided with a stepped notch 234B and 234C, respectively, see FIG. 5A. The damping structure 150 is first lowered through the tip plate opening 131A into the pocket 140 to a position lower than its final home position, see FIG. 5B. First and second positioning wedge pieces 400 and 402 are then inserted into the pocket 140 and positioned into a corresponding stepped notch 234B and 234C, see FIG. 5B. The damping structure 150 is then moved radially toward the external wall outermost portion 120A until the attachment member 154 is located between and gripped by the first and second wedge pieces 400 and 402, see FIG. 5C. The first and second wedge pieces 400 and 402 can be brazed to the ribs 134B and 134C. Further, the attachment member 154 may be brazed to the wedge pieces 400 and 402 and/or to the first and second sidewalls 120 and 122. After the damping structure 150 is mounted to the airfoil 20, the seal plate 131B is positioned over the opening 131A and brazed to the tip plate 131 and the outermost sections 122A and 124A of the first and second sidewalls 122 and 124 of the airfoil external wall 120.

The damping structure 150 further comprises a tip mass member 170 coupled to the second end 152B of the damping element 152, see FIGS. 3 and 4. In the illustrated embodiment, the tip mass member 170 has a generally C-shape such that it can be fitted over the damping element second end 152B. Second pins 172 extend through corresponding openings 170A in the tip mass member 170 and corresponding openings 352B in the damping element second end 152B. The pins 172 may have a diameter of about 1.5 mm and may be formed from a material such as a blade alloy or a tungsten alloy. A weld bead may be provided to hold the pins 172 positioned within the openings 170A in the tip mass member 170.

The tip mass member 170 and the second end 152B of the damping element 152 are free to move relative to the airfoil external wall 120. As noted above, the width or distance between the first and second airfoil sidewalls 122 and 124 at or near the airfoil tip 133 is small, e.g., about 14 mm. Hence, the width $W_5$ of the tip mass member 170 must be selected so as to allow the tip mass member 170 to be positioned between the airfoil sidewalls 122 and 124 at the airfoil tip 133, e.g., the width $W_5$ may equal about 11 mm. Further, sufficient spacing must be provided between the tip mass member 170 and the airfoil first and second sidewalls 122 and 124 to allow for movement of the mass member 170 between the first and second sidewalls 122 and 124. In the illustrated embodiment, it is believed that the tip mass member 170 may move from its centered home positioned between the first and second sidewalls 122 and 124 approximately +/−0.5 mm. The tip mass member 170 may be coated with an oxidation preventative coating, such as M-Cr—Al—Y (where M=Co, Ni or Co/Ni) coating.

During operation of the gas turbine, hot working gases engage the airfoil 20 causing the airfoil tip 133 to oscillate or vibrate so as to bend or move back and forth in the direction of first and second arrows 410A and 410B in FIG. 2 at a bending natural frequency (also referred to herein as "bending normal mode frequency") of the airfoil 20. In the illustrated embodiment, the tip mass member 170 is configured, sized and of a sufficient weight and the damping element 152 is formed from a material and has a shape and size so as to "tune" the damping structure 150 to have a natural frequency that substantially matches the bending normal mode frequency of the airfoil 20. Hence, when the airfoil 20 moves in the direction of either the first or the second arrow 410A, 410B in FIG. 2, it is believed that the damping structure tip mass member 170 will tend to remain motionless in a global coordinate system, which means that it moves in an opposite direction relative to the motion of the airfoil tip 133. This harmonic relative motion imparts a bending force along the length of the damping element 152, thereby applying a force to the airfoil 20 opposing the bending motion of the airfoil 20 sufficient to reduce or nullify, i.e., "damp," the airfoil bending motion. In this manner, it is believed that the damping structure 150 will oscillate in an opposite direction from that of the airfoil 20 resulting in energy being damped and dissipated as internal friction heating within the damping element 152. As noted above, the damping element 152 is preferably formed from a ceramic matrix composite which has a high coefficient of damping material property.

In the illustrated embodiment, it is believed that the bending normal mode frequency of the airfoil 20 may comprise a frequency at or near about 200 Hz. In order to match such a low normal mode frequency, the damping element 152 is preferably formed from a material having a low modulus of elasticity, such as a ceramic matrix composite and the tip mass member 170 is preferably made from a high density material such as a tungsten alloy allowing the tip mass member 170 to have a high enough weight to allow the damping structure 150 to have a low natural frequency matching the bending normal mode frequency of the blade 20 and still be of a size to fit between the first and second sidewalls 120 and 122. In a predicted embodiment, it is believed that the tip mass member 170 may be made from a tungsten-nickel-iron-molybdenum alloy with a density of roughly 17.5 g/cm$^3$ and have a weight equal to about 10 grams.

Figure 6:
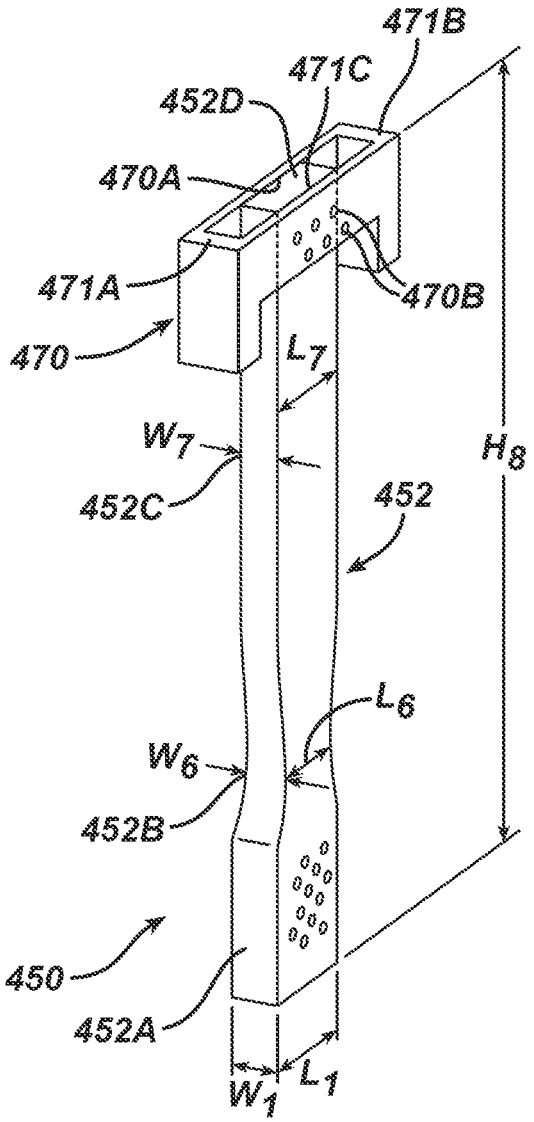
FIG. 6 is an exploded perspective view of a damping structure constructed in accordance with a further embodiment of the present invention.

A damping structure 450 constructed in accordance with a further embodiment of the present invention is illustrated in FIG. 6, where elements in the FIG. 6 embodiment that are the same as those in the FIG. 4 embodiment are referenced by the same reference numerals. The damping structure 450 comprises an attachment member (not shown in FIG. 6), which has substantially the same shape and size as the attachment member 154 described above and illustrated in FIG. 4. The overall height $H_8$ of the damping structure 450 may be about 120 mm.

The damping structure 450 further comprises a damping element 452 having a first section or end 452A, which may be shaped and sized substantially the same as the first end 152A of the damping element 152 illustrated in FIG. 4. The damping element 452 may also comprise an intermediate section 452B having a reduced cross section as compared to the first section 452A so as to have a reduced torsion moment of inertia. For example, the intermediate section 452B may have a length $L_6$ equal to about 15 mm and a width $W_6$ equal to about 8 mm. The damping element 452 also comprises a second section 452C having a cross section different from both the first and intermediate sections 452A and 452B so as to have a reduced bending moment of inertia. For example, the second section 452B may have a length $L_7$ equal to about 20 mm and a width $W_7$ equal to about 6 mm. The second section 452C has an end portion 452D defining a second end of the damping element 452.

The damping structure 450 further comprises a tip mass member 470 coupled to the end portion 452D of the second section 452C of the damping element 452, see FIG. 6. The tip mass member 470 may have a substantial portion of its mass offset from a center of gravity of the mass member 470 so as to induce torsion motion. It is believed that the greater the mass offset, the lower the torsion natural frequency of the damping structure 450. In the illustrated embodiment, the tip mass member 470 comprises outer legs 471A and 471B and an intermediate member 471C extending between the outer legs 471A and 472A. The tip mass member 470 comprises a slot 470A such that the mass member 470 is fitted over the end portion 452D of the second section 452C of the damping element 452 to secure the tip mass member 470 to the damping element 452. Second pins (not shown) extend through corresponding openings 470B in the tip mass member 470 and corresponding openings (not shown) in the damping element end portion 452D of the second section 452C. A weld bead (not shown) may be provided to hold the pins positioned within the openings 470B in the tip mass member 470.

It is believed that the tip mass member 470 and the damping element 452 may be configured and sized so as to cause the damping structure 450 to substantially match a bending normal mode frequency and a torsion normal mode frequency of the airfoil.

The tip mass member 470 and the end portion 452D of the second section 452C of the damping element 452 are free to move relative to the airfoil external wall 120. The attachment member is coupled to the airfoil 120 at a location within the internal cavity 130 inwardly from the airfoil tip 133 such that the end portion 452D of the second section 452C of the damping element 452 and the tip mass member 470 are located near the airfoil tip 133.

During operation of the gas turbine, hot working gases engage the airfoil 20 and may cause the airfoil tip 133 to oscillate or vibrate so as to bend or move back and forth in the direction of first and second arrows 410A and 410B in FIG. 2 at a bending natural frequency (also referred to herein as "bending normal mode frequency") of the airfoil 20. The hot working gases engaging the airfoil 20 may also cause the airfoil tip 133 to oscillate or vibrate back and forth in a twisting or rotational motion about a central axis A, see arrow 510 in FIG. 2, at a torsion natural frequency (also referred to herein as "torsion normal mode frequency") of the airfoil 20. In the illustrated embodiment, the tip mass member 470 is configured, sized and of a sufficient weight and the damping element 452 is formed from a material and has a shape and size so as to "tune" the damping structure 450 to have a natural frequency that substantially matches the bending normal mode frequency of the airfoil 20 and, further, to have a torsion natural frequency that substantially matches the torsion natural or torsion mode frequency of the airfoil 20. Hence, when the airfoil 20 moves in the direction of either the first or the second arrow 410A, 410B in FIG. 2, it is believed that the damping structure tip mass member 470 will tend to remain motionless in a global coordinate system, which means that it moves in an opposite direction relative to the motion of the airfoil tip 133. This harmonic relative motion imparts a bending force along the length of the damping element 452, thereby applying a force to the airfoil 20 opposing the bending motion of the airfoil 20 sufficient to reduce or nullify, i.e., "damp," the airfoil bending motion. When the airfoil 20 moves in a first rotational direction about axis A, it is believed that the damping structure 450 moves in an opposite rotational direction, relative to the motion of the airfoil tip 133. This harmonic relative twisting motion imparts a torsion force which concentrates stress in the damping element at the location of low torsion moment of inertia, thereby applying a force to the airfoil 20 opposing the rotational motion of the airfoil 20 sufficient to reduce or nullify, i.e., "damp," the airfoil rotational motion. In this manner, it is believed that the damping structure 450 oscillates in an opposite direction from that of the airfoil 20 resulting in energy being damped and dissipated as internal friction heating within the damping element 452. The damping element 452 is preferably formed from a ceramic matrix composite which has a high coefficient of damping material property.

In the illustrated embodiment, the tip mass member 470 may be made from a tungsten-nickel-iron-molybdenum alloy with a density of roughly 17.5 g/cm$^3$.

It is also believed that a tip mass member may be configured and sized so as to cause the damping structure to substantially match only a torsion normal mode frequency of the airfoil.

It is further contemplated that the tip mass member and/or the attachment member may be coupled to the damping element via means other than pins, such as using bolts, clamps or wedges.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A turbine blade comprising:

a root;

an airfoil comprising an external wall extending radially from said root and having a radially outermost portion, said external wall comprising first and second side walls joined together at leading and trailing edges to define an inner cavity of said airfoil; and a damping structure positioned within said airfoil inner cavity and coupled to said airfoil so as to define a tuned mass damper, said damping structure including a width dimension extending between said first and second side walls and a length dimension greater than said width dimension extending in a direction between said leading and trailing edges, and said damping structure comprising:

a damping element having a first end and a second end, said first end being coupled to said airfoil and said second end being free to move within said airfoil inner cavity;

a tip mass member formed of a high density material different from a material defining said damping element and attached to said second end of said damping element; and said tip mass member movable with said second end of said damping element in a direction toward and away from said side walls.

2. The turbine blade as set out in claim 1, wherein said second end of said damping element being located near said external wall radially outermost portion and said first end of said damping element being located nearer to said root than said second end of said damping element.

3. The turbine blade as set out in claim 2 wherein said damping structure further comprises an attachment member coupled to said first end of said damping element, said attachment member coupling said damping element to said airfoil.

4. The turbine blade as set forth in claim 1, wherein said tip mass member is configured and sized so as to cause said damping structure to substantially match a bending normal mode frequency of said airfoil.

5. The turbine blade as set forth in claim 1, wherein said tip mass member has a generally U-shape configuration so as to be fitted over said second end of said damping element.

6. The turbine blade as set forth in claim 1, wherein said tip mass member is configured and sized so as to cause said damping structure to substantially match a torsion normal mode frequency of said airfoil.

7. The turbine blade as set forth in claim 1, wherein said tip mass member has a substantial portion of its mass offset from a center of gravity of said mass member.

8. The turbine blade as set out in claim 1, wherein said damping element comprises a ceramic matrix composite damping element.

9. The turbine blade as set out in claim 8, wherein said damping structure further comprises a tungsten alloy tip mass member coupled to said second end of said damping element.

10. A turbine blade comprising:

a root;

an airfoil comprising an external wall coupled to and extending radially from said root and having a radially outermost portion, said external wall comprising first and second side walls joined together at leading and trailing edges to define an inner cavity of said airfoil; and a damping structure positioned within said airfoil inner cavity and coupled to said airfoil so as to define a tuned mass damper, said damping structure including a width dimension extending between said first and second side walls and a length dimension greater than said width dimension extending in a direction between said leading and trailing edges, and said damping structure comprising:

a ceramic matrix composite damping element having a first end and a second end, said first end being coupled to said airfoil and said second end being free to move within said airfoil inner cavity; and a tungsten alloy tip mass member attached to said second end of said damping element;

said tip mass member movable with said second end of said damping element in a direction toward and away from said side walls.

11. The turbine blade as set out in claim 10, wherein said second end of said damping element being located near said external wall radially outermost portion and said first end of said damping element being located nearer to said root than said second end of said damping element.

12. The turbine blade as set out in claim 11, wherein said damping structure further comprises an attachment member coupled to said first end of said damping element, said attachment member coupling said damping element to said airfoil.

13. The turbine blade as set forth in claim 10, wherein said tip mass member is configured and sized so as to cause said damping structure to substantially match a bending normal mode frequency of said airfoil.

14. The turbine blade as set forth in claim 10, wherein said tip mass member has a generally U-shape configuration so as to be fitted over said second end of said damping element.

15. The turbine blade as set forth in claim 10, wherein said tip mass member is configured and sized so as to cause said damping structure to substantially match a torsion normal mode frequency of said airfoil.

* * * * *